US010106384B2

(12) United States Patent
Bigoney et al.

(10) Patent No.: US 10,106,384 B2
(45) Date of Patent: Oct. 23, 2018

(54) BOOM ASSEMBLY WITH YAW ADJUSTMENT

(71) Applicant: J. C. Bamford Excavators Limited, Uttoxeter, Staffordshire (GB)

(72) Inventors: Paul Bigoney, Uttoxeter (GB); Doug McIlwain, Uttoxeter (GB)

(73) Assignee: J. C. Bamford Excavators Limited, Uttoxeter, Staffordshire (GB)

( * ) Notice: Subject to any disclaimer, the term of this patent is extended or adjusted under 35 U.S.C. 154(b) by 138 days.

(21) Appl. No.: 14/868,015

(22) Filed: Sep. 28, 2015

(65) Prior Publication Data

US 2016/0090282 A1 Mar. 31, 2016

(30) Foreign Application Priority Data

Sep. 29, 2014 (GB) ..... 1417130.0

(51) Int. Cl.

| | |
|---|---|
| ***B66C 23/62*** | (2006.01) |
| ***B66F 9/065*** | (2006.01) |
| ***E02F 3/28*** | (2006.01) |
| ***E02F 3/34*** | (2006.01) |

(52) U.S. Cl.

CPC ..... *B66F 9/0655* (2013.01); *B66C 23/62* (2013.01); *E02F 3/286* (2013.01); *E02F 3/3414* (2013.01)

(58) Field of Classification Search

CPC ..... A01B 59/002; B66C 23/64; B66C 23/701; B66C 23/703; B66C 23/705; B66C 23/706; B66C 23/707; B66F 9/061; B66F 9/065; B66F 9/0655; E02F 3/283; E02F 3/286; E02F 3/3414; E02F 3/382; E02F 3/627; E02F 3/6276; E02F 9/006; F15B 15/06; F16C 11/02; F16C 2350/26; Y10T 403/32508; Y10T 403/7069

USPC ..... 403/409.1; 414/686, 718, 722

See application file for complete search history.

(56) References Cited

U.S. PATENT DOCUMENTS

| | | | | |
|---|---|---|---|---|
| 1,943,364 A * | 1/1934 | Betz | F16J 1/16 | 403/128 |
| 3,135,402 A * | 6/1964 | McCanse | E02F 3/3408 | 403/53 |
| 3,688,929 A * | 9/1972 | McIntyre | B66F 9/065 | 414/687 |
| 4,034,875 A * | 7/1977 | Pugh | B66F 9/0655 | 137/355.17 |

(Continued)

FOREIGN PATENT DOCUMENTS

| | | | |
|---|---|---|---|
| EP | 325064 A1 * | 7/1989 | B66F 9/065 |
| JP | 8-199617 | 8/1996 | |

OTHER PUBLICATIONS

Extended European Search Report for EP 15 18 3462, dated Mar. 2, 2016.

Search Report for GB 1417130.0, dated Mar. 13, 2015.

*Primary Examiner* — Gerald McClain
*Assistant Examiner* — Brendan P Tighe
(74) *Attorney, Agent, or Firm* — Marshall, Gerstein & Borun LLP

(57) ABSTRACT

A boom of a wheeled loader or digger is pivoted about a horizontal axis in a fork. Yaw adjustment is provided by opposed taper plugs which constitute a spindle of the boom. The taper portions of the plugs are eccentric with respect to the bearing portions and may be rotationally adjusted to correct misalignment of the boom in yaw. A threaded fastener locks the taper plugs to the boom.

20 Claims, 4 Drawing Sheets

(56) References Cited

U.S. PATENT DOCUMENTS

| | | | | | |
|---|---|---|---|---|---|
| 4,042,135 | A * | 8/1977 | Pugh | B66F 9/0655 | 212/278 |
| 4,089,613 | A * | 5/1978 | Babbitt, Jr. | F16B 5/025 | 403/370 |
| 4,674,944 | A * | 6/1987 | Addleman | B66F 9/0655 | 414/706 |
| 4,718,325 | A | 1/1988 | Shore | | |
| 5,320,443 | A * | 6/1994 | Lien | E02F 9/006 | 403/154 |
| 5,478,192 | A * | 12/1995 | Bentivoglio | B66F 9/0655 | 180/251 |
| 5,807,061 | A * | 9/1998 | Donoghue | E02F 3/3411 | 414/697 |
| 6,439,827 | B1 * | 8/2002 | Ratcliffe | B66F 9/0655 | 180/291 |
| 8,979,211 | B2 * | 3/2015 | Marshall | E21C 35/00 | 279/2.02 |
| 2001/0043855 | A1 | 11/2001 | Granroth et al. | | |
| 2004/0009057 | A1 * | 1/2004 | Branham | E02F 3/382 | 414/680 |
| 2009/0087292 | A1 | 4/2009 | Holloway et al. | | |
| 2013/0142606 | A1 | 6/2013 | Wager et al. | | |

* cited by examiner

BOOM ASSEMBLY WITH YAW ADJUSTMENT

TECHNICAL FIELD

This invention relates to a boom, for example of a wheeled loader or digger, and particularly to yaw adjustment for alignment of the boom with the fork to which it is mounted.

BACKGROUND OF THE INVENTION

Telescopic booms are typically mounted to loaders and diggers in order to provide adjustable reach. Such booms are pivoted with respect to a chassis, which may be wheeled or tracked, and which is commonly self-propelled. In one example the boom is horizontally pivoted to the rear of a wheeled chassis so as to extend forwardly; a driver's cab is provided on the chassis at the side of the boom, and the long axis of the boom is offset to one side of the centreline of the chassis. Such a boom may be raised and lowered by hydraulic ram, and include one or more telescopic sections which may be advanced or retracted on demand to adjust the reach thereof.

It is desirable for the long axis of the boom to be parallel to the fore and aft centreline of the chassis. However the chassis mounting of the boom typically consists of a welded fabrication of many steel plate components, and it may be problematic to ensure that the pivot axis of the boom is perpendicular to the fore and aft centreline of the vehicle whilst maintaining other tolerances and dimensional requirements. In particular the pivot axis may be defined in separate steel plate components having bores which are independently machined, and line boring after fabrication may be impractical. Furthermore distortion of the fabricated assembly may occur during welding thereof.

It will be appreciated that any misalignment of the long axis of the boom is magnified at maximum boom extension, and that such misalignment becomes apparent after assembly of the boom to the chassis.

It would be desirable to provide yaw adjustment of the boom after manufacture and assembly of the device to which the boom is fitted.

SUMMARY OF THE INVENTION

According to a first aspect of the invention there is provided a boom assembly comprising a support having forks, and a boom pivoted between the forks on a spindle about a substantially horizontal pivot axis, wherein the spindle includes a circular bearing portion for the forks and a circular boom portion for the boom, the boom portion being eccentric with respect to the bearing portion so that rotation of the spindle moves the beam in yaw with respect to the forks.

In one embodiment the boom comprises a circular through hole tapering inwardly from respective ends towards the middle, and the spindle comprises two plugs, one each insertable into a respective end of said through hole, each plug having a circular tapered portion to match the respective taper of the through hole, and a circular pivot bearing portion for engagement in a respective fork, wherein the tapered portion of each plug is eccentric with respect to the bearing portion.

Such an arrangement permits yaw adjustment by relative rotation of the spindle, in particular one or both of the plugs.

The plugs provide the spindle of the boom upon locking of the taper portions of the plug and with the taper portions of the through bore.

In one embodiment a threaded fastener is provided to draw the plugs together, thereby to make them immovable with respect to the boom. The threaded fastener may pass through one of the plugs to engage the other, and may furthermore be captive so as to separate the plugs upon unscrewing thereof.

Separate plugs provides for easy assembly of the boom and fork, and moreover the tapered plugs permits relatively easy location of each plug in the mouth of the through bore; this avoid the necessity of aligning the boom and fork to a close accuracy before inserting the usual one-piece spindle.

The arrangement of the invention allows adjustment of the yaw angle after a period of use, or upon replacement of components of the boom assembly.

According to a second aspect of the invention there is provided a method of adjusting yaw of a boom assembly of the invention, the method comprising positioning the boom in the forks; inserting the plugs through a respective fork into the through hole from either side, the tapered portions of the plugs being in sliding engagement with the through hole; rotating one or more of the plugs to adjust the yaw angle of said boom with respect to the forks; and bringing the plugs into taper locking engagement with the through hole to render the plugs rotationally immovable with respect to the through hole.

Other features of the invention will be apparent from the claims appended hereto, and from the description.

BRIEF DESCRIPTION OF THE DRAWINGS

Other features of the invention will be apparent from the following description of an embodiment of the invention described by way of example only in the accompanying drawings in which:—

DETAILED DESCRIPTION

The accompanying drawings of FIGS. 1-5 are schematic and illustrative; they do not represent particular dimensions or proportions and are intended to convey the principles of the invention without dimensional limitation or absolute diagrammatic accuracy.

Figure 1:
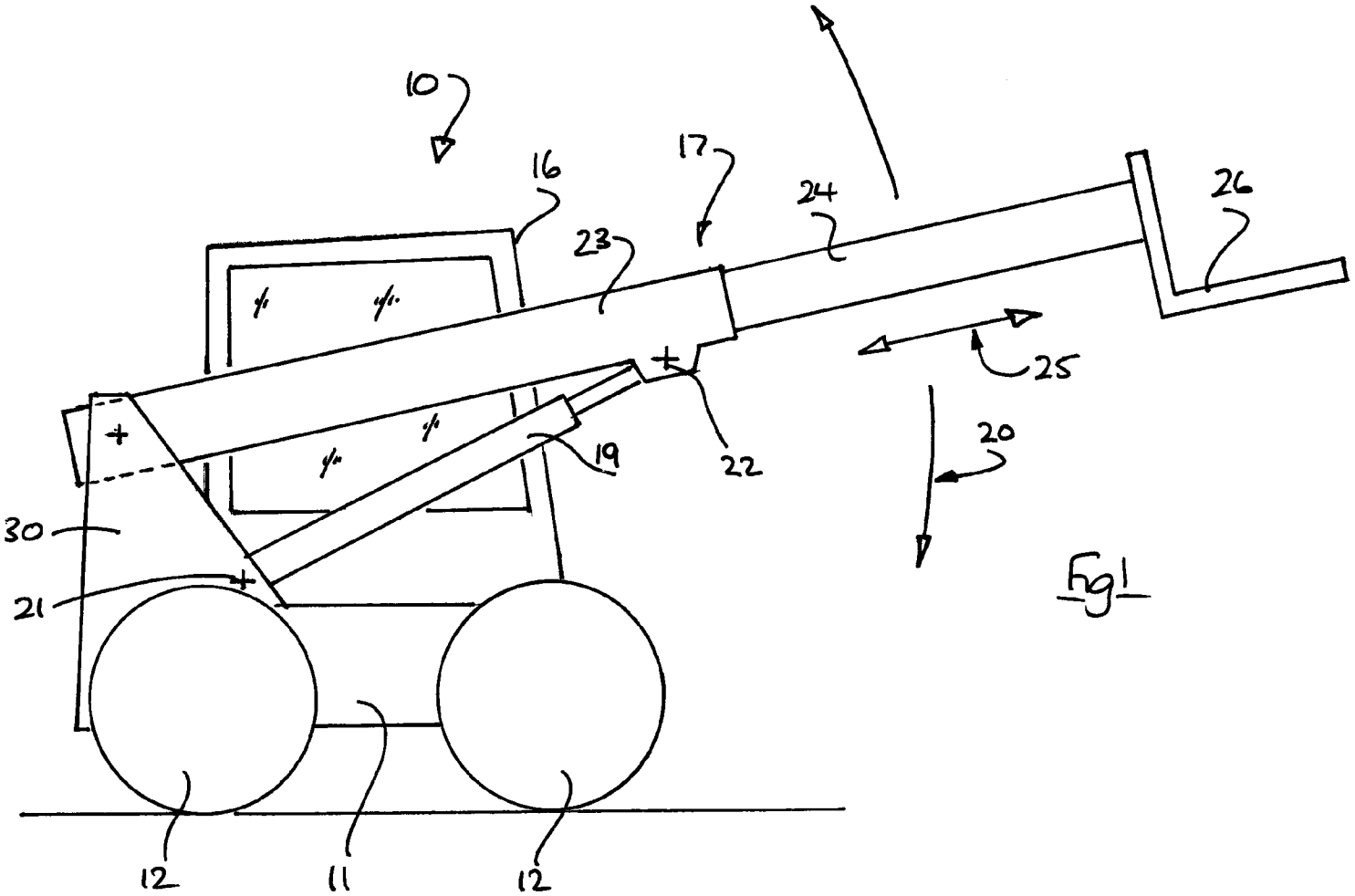
FIG. 1 is a side elevation of an exemplar self-propelled loader having a telescopic boom assembly.
Figure 2:
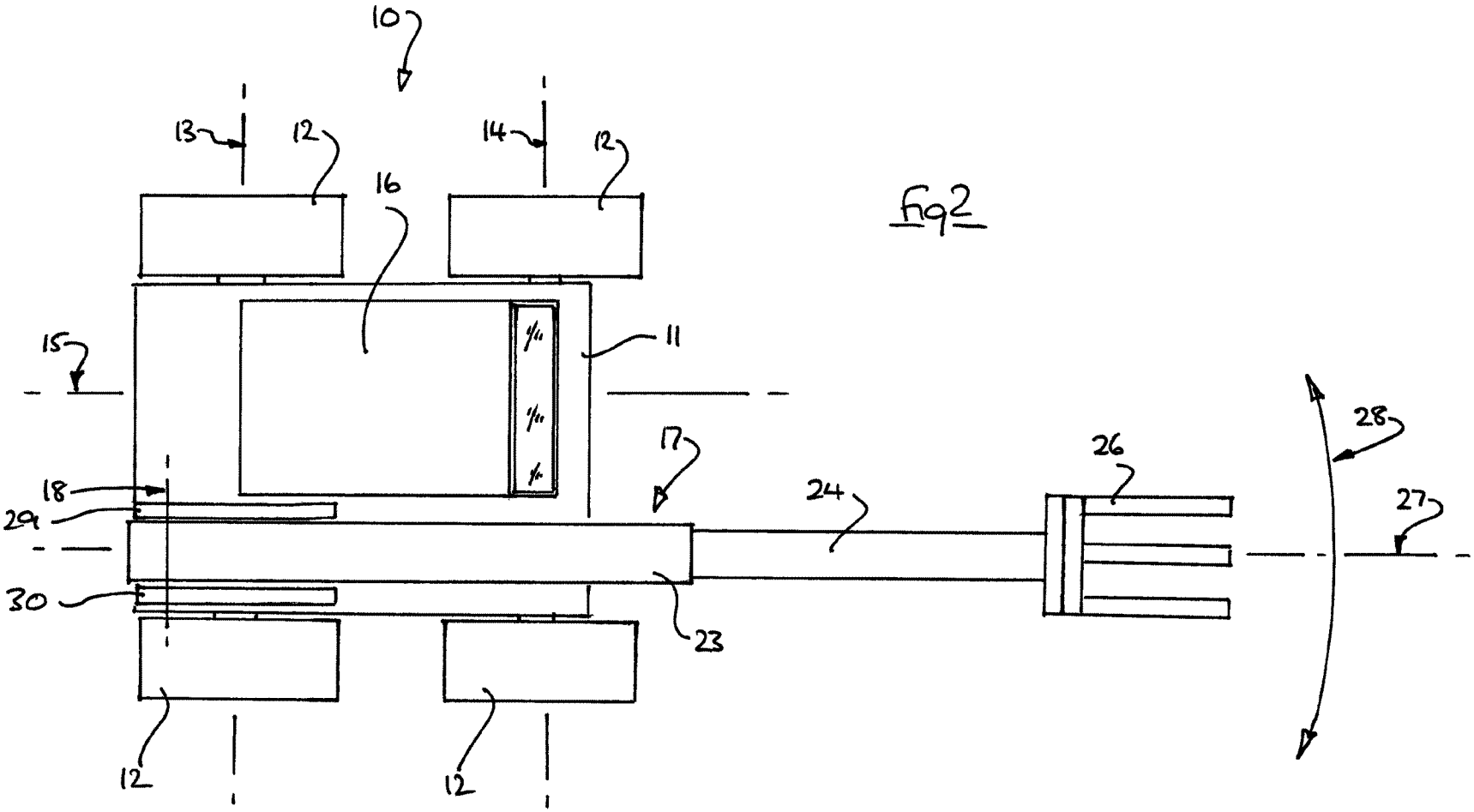
FIG. 2 is a plan view of the loader of FIG. 1.

With reference to FIGS. 1 and 2 a wheeled self-propelled loader 10 comprises a chassis 11 having four wheels 12 rotatable about parallel axes 13, 14. A fore and aft centreline of the loader has an axis 15 which is orthogonal to the axes 13, 14, and defines a straight direction of travel. The loader may have a skid-steer chassis whereby direction is determined by braking one or more wheels whilst driving other wheels; however a conventional steerable chassis may also be provided, or a chassis with tracks.

A driver's cab 16 is provided at one side of the chassis, and a telescopic boom 17 is pivoted to the rear of the chassis about pivot axis 18, so as to lie alongside the cab 15. Such an arrangement provides a vehicle of compact dimensions when the boom assembly 17 is retracted.

The boom 17 may be raised or lowered by hydraulic ram 19 pivoted on the vehicle at vehicle pivot 21, and on the boom at boom pivot 22. Raising and lowering is in the direction indicated by double headed arrow 20.

The boom 17 comprises an outer section 23, and a single telescopic inner section 24 which may be extended or retracted by a driver under hydraulic control in the direction indicated by double headed arrow 25. As illustrated the inner section of the boom carries a fork 26, but other attachments are possible, including a grab, a bucket or the like, of conventional kind.

It is desirable that the long axis 27 of the boom (FIG. 2) is parallel to the fore and aft axis 15 so as to minimize yaw misalignment, as represented by double headed arrow 28.

As described so far, the loader of FIGS. 1 and 2 is conventional. The chassis comprises a steel fabrication to which upstanding arms 29, 30 are provided, and which define the pivot axis 18. The boom is typically fork mounted on the axis 18 by a pivot pin in corresponding through holes (not shown) of the arms 29, 30.

Figure 3:
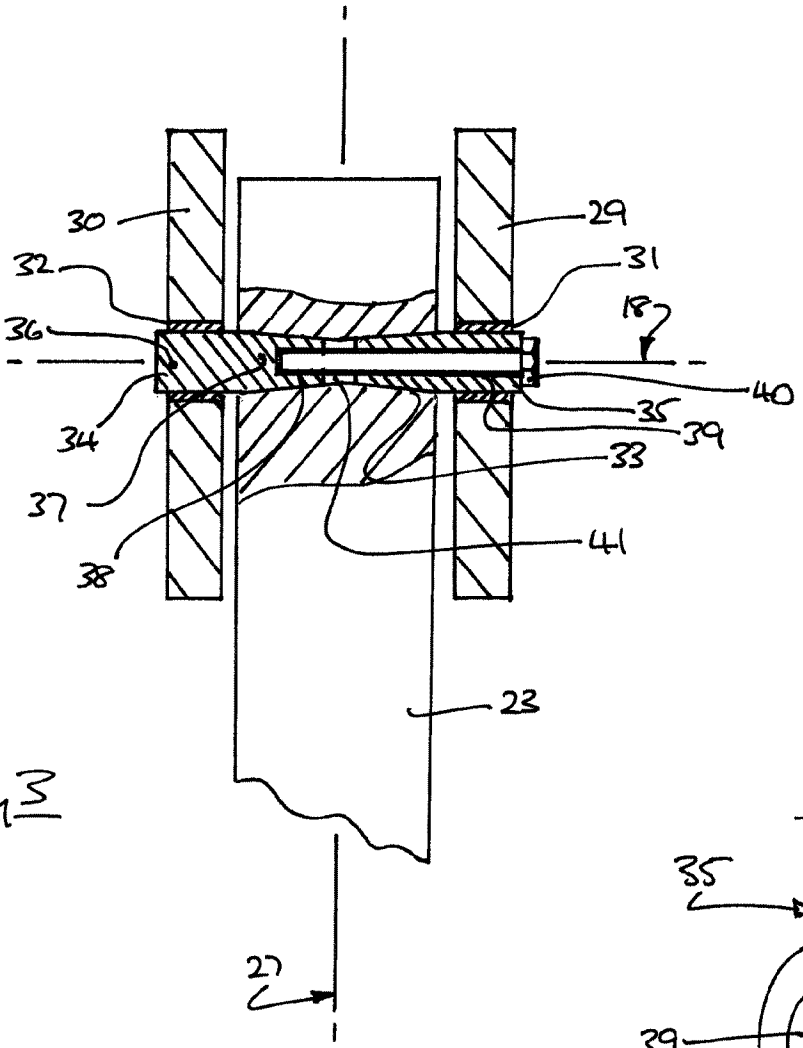
FIG. 3 is a schematic cross-section on the pivot axis of the boom assembly of FIG. 1, illustrating the principles of the invention.

FIG. 3 illustrates a somewhat simplified embodiment of the invention, corresponding components having the reference numerals of FIGS. 1 and 2. The upstanding arms 29, 30 define a fork into which the outer section 23 of the boom is pivoted about pivot axis 18.

Each arm 29, 30 defines a through aperture on axis 18 in which is provided a respective circular plain bearing 31, 32. The outer section 23 also defines a through bore 33, which is inwardly tapered from the opposite outer sides to the middle, so that the minimum diameter is at the centre, and substantially aligned with the long axis 27 of the boom. A plain diameter portion may be provided at the outer and middle portions of the through bore 33, but the tapered portion should be straight, smooth and continuous, as will become apparent.

The pivot pin for the boom assembly comprises two separate and similar plugs 34, 35, which each comprise a fixed diameter circular bearing portion 36 and a tapered circular nose portion 37 to correspond to a respective tapered portion of the through bore 33.

The bearing portions 36 have a diameter corresponding to the plain bearings 31, 32 so as to provide pivoting support for the boom assembly 17.

The left plug 34 (as viewed) includes a female thread 38 at the tapered end, whereas the right plug 35 has a through hole 39 at a clearance diameter for a threaded bolt 40, which engages the female thread 38 in use. It will be understood that tightening the bolt 40 draws the plugs 34, 35 together, and against the tapered surfaces of the through bore 33, so that in use the plugs 34, 35 can become immovable with respect to the outer section 23 yet provide for pivoting thereof about the pivot axis 18 in the respective circular bearings 31, 32. A centre clearance 41 is provided between the plugs 34, 35 in the assembly condition (as illustrated) to avoid bottoming thereof.

Figure 4:
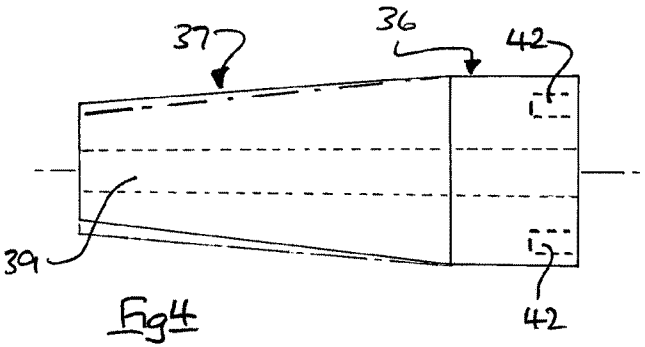
FIG. 4 is a schematic axial cross-section through a tapered eccentric plug of the invention.
Figure 5:
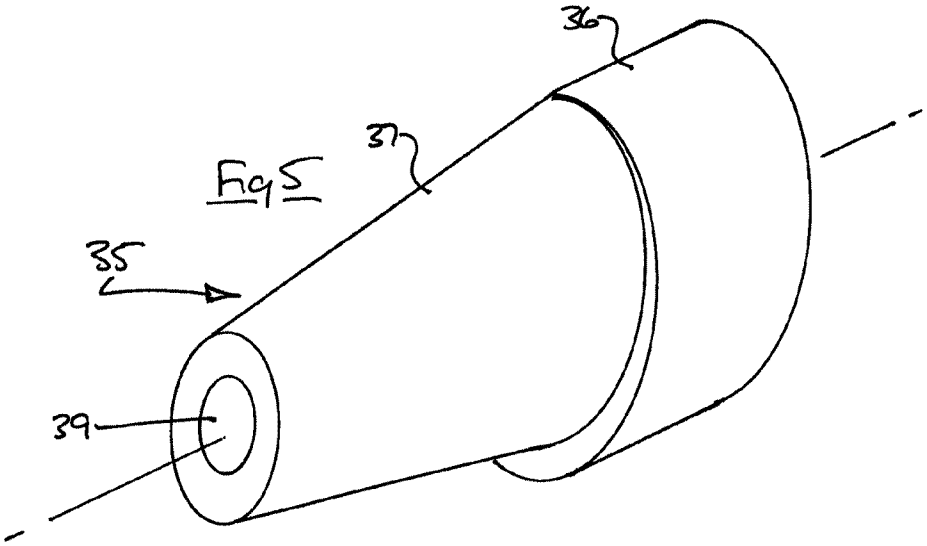
FIG. 5 is a schematic perspective view of a tapered eccentric plug of the invention.

The right plug 35 is illustrated in FIGS. 4 and 5. The plain diameter of the circular bearing portion 36, and the tapered nose portion 37 can be clearly seen. The tapered nose portion is however symmetrically eccentric, with maximum eccentricity at the bottom, as viewed. Accordingly upon rotation thereof the nose portion 37 will shift transversely relative to the bearing portion 36 between the solid outline of FIG. 4 to the chain-dot outline of FIG. 4, and back again. By this means rotation of the plug 35 causes relative fore and aft movement of the corresponding side of the outer section 23 with respect to the arm 29, and hence movement of the boom assembly in the yaw direction.

The plug 34 has the same exterior form as the plug 35, but as noted above the through hole 39 is replaced by a female thread 38. The plug 34 may be rotated relative to the outer section 23 to cause relative movement with respect to the arm 30.

The plugs 34, 35 may be rotated in situ by any suitable means, for example a peg spanner engageable in recesses 42 (FIG. 4), or by external flats of the plugs 34, 35.

In use the outer section 23 is placed between the arms 29, 30, and the plugs 34, 35 are inserted to position the boom. The boom is extended, to maximize yaw error at the free end of the inner section 24, and the yaw discrepancy measured. If out of tolerance, one or both plugs 34, 35 are rotated to slew the boom assembly until parallel with the fore and aft centreline 15. In this condition the bolt 40 is tightened to draw the tapered portions 37 into friction locking engagement with the tapered surfaces of the bore 33, thus rendering them immovable with respect to the outer section 23.

Certain components and minor features are omitted in the cross-section of FIG. 3 in order to improve clarity, for example grease passages, and thrust washers between the outer section 23 and arms 29, 30.

A typical plug 34, 35 may have a maximum diameter of around 60 mm, a bearing length of around 50 mm, an overall length of around 130 mm and included taper angle of 7.5°. The taper offset may be around 1 mm, which is sufficient to give a corrective yaw movement within manufacturing tolerances of the described embodiment.

Figure 6:
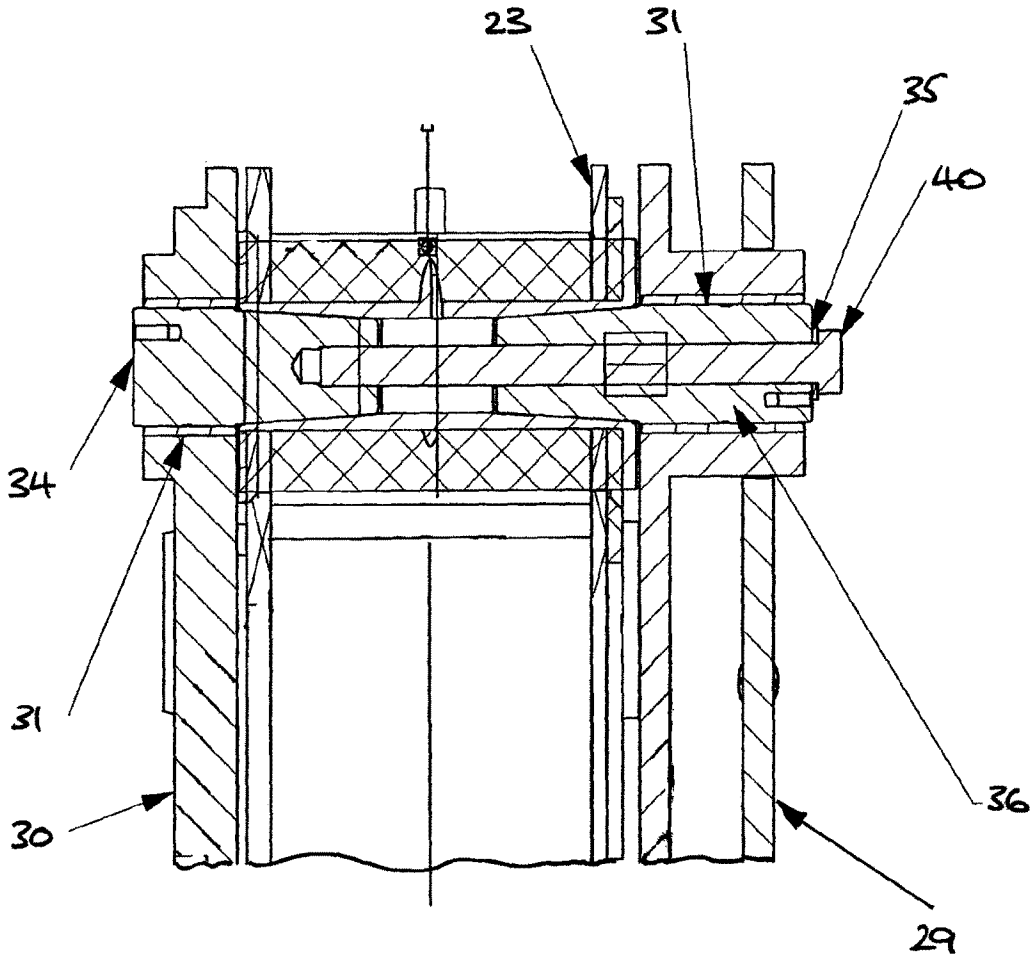
FIG. 6 is a cross-section corresponding to FIG. 3, and illustrating a practical embodiment of the invention.

FIG. 6 corresponds to FIG. 3 and shows a practical embodiment of the invention. Constructional details of the arm 29, 30 differ, and the bolt 40 is retained within the plug 35 so as to urge the plugs 34, 35 apart upon unscrewing, thereby to break the taper lock with the through bore 33 on demand. In the alternative a hydraulic fitting may be provided to permit the clearance 41 to be pressurized, thereby to break the tapered engagement. The boom is typically a box section in order to reduce mass thereof whilst retaining strength and stiffness.

The invention has been described in relation to a wheeled loader. It will however be apparent that the invention may be applied to any fork mounted boom having a substantially horizontal pivot, whether on a self-propelled vehicle or not.

The materials of the invention are conventional, being suitable grades of steel and bearing materials of a kind habitually used in machines with booms, in particular construction machinery.

Variants and modifications of the invention are possible within the scope of the appended claims.

The invention claimed is:

1. A boom assembly comprising:

a support having upstanding arms, and a boom pivoted between the upstanding arms on a spindle about a substantially horizontal pivot axis, wherein the spindle includes a circular bearing portion for the upstanding arms, and a circular boom portion for the boom, the circular boom portion being eccentric with respect to the circular bearing portion so that rotation of the circular bearing portion of the spindle moves the boom in yaw with respect to the upstanding arms;

the spindle including a clearance hole aligned with a central axis of the spindle, wherein the central axis of the spindle is coaxially aligned with the horizontal pivot axis.

2. The boom assembly according to claim 1 wherein the boom comprises a circular through hole tapering inwardly from respective ends towards a middle, and the spindle comprises two plugs, one each insertable into a respective end of said through hole, each plug having a circular tapered portion to match the respective taper of the through hole, and a circular pivot bearing portion for engagement in a respective upstanding arm, wherein the tapered portion of each plug is eccentric with respect to the bearing portion.

3. The boom assembly of claim 2 and further including a threaded fastener on said pivot axis, and adapted to draw said plugs together.

4. The boom assembly according to claim 3 wherein said threaded fastener is adapted to urge said plugs apart.

5. The boom assembly of claim 4 wherein said fastener is captive in one of said plugs.

6. The boom assembly of claim 3 wherein said threaded fastener comprises a bolt passing through the clearance hole of one of said plugs, and engageable in a female thread of said other plug.

7. The boom assembly of claim 2 wherein said plugs include a plurality of blind holes in the outer respective end faces for engagement by a peg spanner, thereby to permit rotation thereof.

8. The boom assembly of claim 2 wherein each plug has a tapered portion having an included angle in the range 5 to 15°.

9. The boom assembly of claim 8 wherein said included angle is in the range 7 to 8°.

10. The boom assembly of claim 2 wherein the tapered portions of said plugs have an eccentricity in the range 0.5 to 2 mm.

11. The boom assembly according to claim 10 wherein said eccentricity is in the range 0.8 to 1.2 mm.

12. The boom assembly according to claim 2 wherein the tapered portion of said plugs are substantially identical in length and included angle.

13. The boom assembly of claim 12 wherein the axial length of the tapered portion is in the range 70 to 90 mm.

14. The boom assembly of claim 13 wherein the diameter of the circular bearing portion is in the range 50 to 70 mm.

15. The boom assembly according to claim 14 wherein the minimum axial length of the bearing portion is 50 mm.

16. The boom assembly of claim 1 wherein said boom is telescopic.

17. A self-propelled vehicle having the boom assembly of claim 1.

18. A method of adjusting the yaw angle of a boom assembly of claim 2, the method comprising:

positioning said boom between said upstanding arms;

inserting said plugs through a respective upstanding arm and into said through hole of the boom from either side of the boom, the tapered portions of said plugs being in sliding engagement with said through hole;

rotating one or more of said plugs to adjust the yaw angle of said boom with respect to said upstanding arms; and bringing said plugs into taper locking engagement with said through hole to render said plugs rotationally immovable with respect to said through hole.

19. The method according to claim 18 wherein said plugs are brought into taper locking engagement by means of a threaded fastener drawing said plugs together.

20. The method according to claim 18 wherein said plugs are urged out of taper locking engagement by means of a threaded fastener held captive on one of said plugs.

* * * * *